US009016726B2

(12) United States Patent
Rauch et al.

(10) Patent No.: US 9,016,726 B2
(45) Date of Patent: Apr. 28, 2015

(54) SECURITY ELEMENT HAVING A MICROSTRUCTURE

(75) Inventors: Andreas Rauch, Ohstadt (DE); Michael Rahm, Bad Tölz (DE); Manfred Heim, Bad Tölz (DE); Christian Fuhse, Otterfing (DE)

(73) Assignee: Giesecke & Devrient GmbH, Munich (DE)

( * ) Notice: Subject to any disclaimer, the term of this patent is extended or adjusted under 35 U.S.C. 154(b) by 277 days.

(21) Appl. No.: 13/510,714

(22) PCT Filed: Nov. 15, 2010

(86) PCT No.: PCT/EP2010/006943

§ 371 (c)(1),
(2), (4) Date: May 18, 2012

(87) PCT Pub. No.: WO2011/060910

PCT Pub. Date: May 26, 2011

(65) Prior Publication Data

US 2012/0228860 A1 Sep. 13, 2012

(30) Foreign Application Priority Data

Nov. 19, 2009 (DE) ..... 10 2009 053 925

(51) Int. Cl.
*B42D 15/00* (2006.01)
*B42D 25/29* (2014.01)
*B42D 25/324* (2014.01)

(52) U.S. Cl.
CPC ..... *B42D 25/29* (2014.10); *B42D 2035/36* (2013.01); *B42D 25/324* (2014.10)

(58) Field of Classification Search
CPC . B42D 15/00; B42D 2033/24; B42D 2035/28
USPC ..... 283/901, 902
See application file for complete search history.

(56) References Cited

U.S. PATENT DOCUMENTS 3,887,742 A * 6/1975 Reinnagel ..... 283/902
5,728,449 A * 3/1998 Steininger et al. ..... 283/72

(Continued)

FOREIGN PATENT DOCUMENTS

DE 102006052413 A1 5/2008
EP 1545902 T1 9/2003

(Continued)

OTHER PUBLICATIONS

International Preliminary Report on Patentability and Written Opinion for PCT/EP2010/006943, Jun. 12, 2012.

(Continued)

*Primary Examiner* — Kyle Grabowski
(74) *Attorney, Agent, or Firm* — Workman Nydegger

(57) ABSTRACT

The invention relates to a security element for security papers, value documents and the like with at least one microstructure which has a visual appearance that is viewing angle-dependent in transmission, whereby the at least one microstructure is formed from an arrangement of a multiplicity of structure elements with a characteristic structure spacing of 1 μm or more. According to the invention it is provided that the security element contains at least one motif image which, through the viewing angle-dependent visual appearance of the microstructure, is visible in transmission from certain viewing angles, and invisible in transmission from other viewing angles, and that the microstructure and the motif image together have a thickness of 50 μm or less.

28 Claims, 6 Drawing Sheets

(56) References Cited

U.S. PATENT DOCUMENTS

| | | | | |
|---|---|---|---|---|
| 6,283,509 | B1 * | 9/2001 | Braun et al. | 283/72 |
| 7,630,954 | B2 * | 12/2009 | Adamczyk et al. | 283/72 |
| 8,137,899 | B1 * | 3/2012 | Muller et al. | 283/72 |
| 2005/0224203 | A1 | 10/2005 | Boehm et al. | |
| 2006/0127649 | A1 | 6/2006 | Keller et al. | |
| 2008/0171144 | A1 * | 7/2008 | Raksha et al. | 427/162 |
| 2009/0127844 | A1 * | 5/2009 | Dorfler et al. | 283/85 |
| 2009/0230670 | A1 * | 9/2009 | Schmid et al. | 283/85 |
| 2010/0194091 | A1 * | 8/2010 | Heim et al. | 283/85 |

FOREIGN PATENT DOCUMENTS

| | | | |
|---|---|---|---|
| WO | 03054297 | A2 | 7/2003 |
| WO | WO2004/030928 | A1 * | 4/2004 |
| WO | 2008049533 | A2 | 5/2008 |
| WO | 2008055658 | A1 | 5/2008 |

OTHER PUBLICATIONS

International Search Report for PCT/EP2010/006943, Mar. 14, 2011.

* cited by examiner

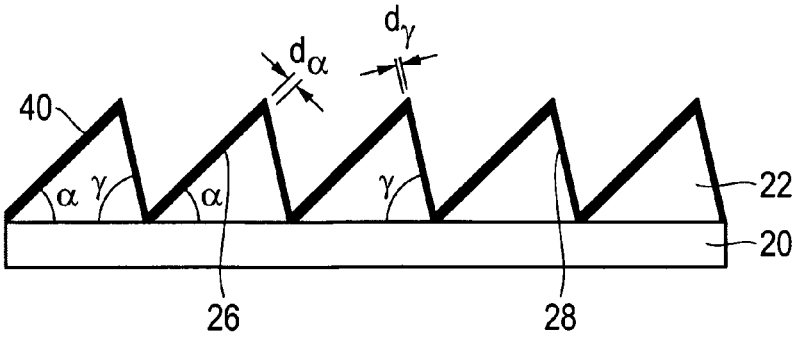
Fig. 3
Fig. 4a
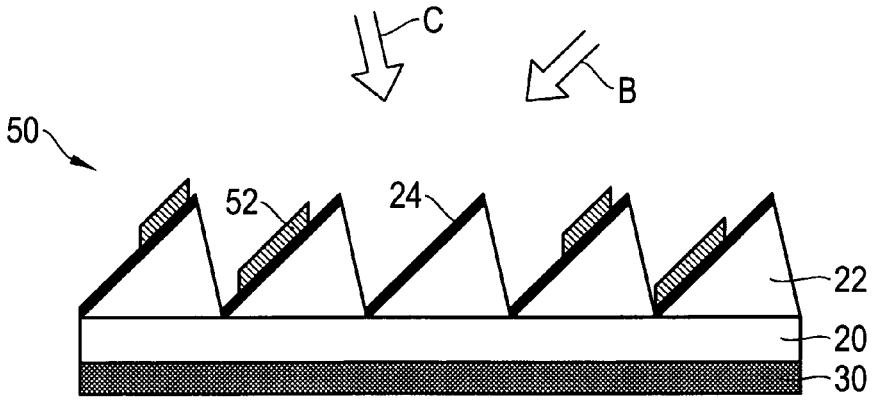
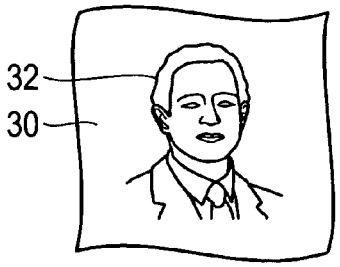
Fig. 4b
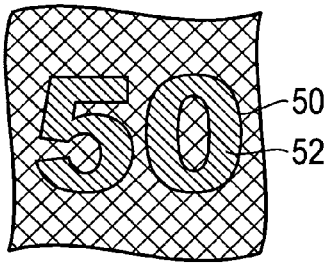
Fig. 4c

SECURITY ELEMENT HAVING A MICROSTRUCTURE

BACKGROUND OF THE INVENTION

A. Field of the Invention

This invention relates to a security element for security papers, value documents and the like with at least one microstructure which has a visual appearance that is viewing angle-dependent in transmission.

B. Related Art

Data carriers, such as value documents or identification documents, or other objects of value, such as branded articles, are often provided for safeguarding purposes with security elements which permit a verification of the authenticity of the data carriers and which at the same time serve as protection from unauthorized reproduction. The security elements can be configured for example in the form of a security thread embedded in a bank note, a tear thread for product packages, an applied security strip, a cover foil for a bank note with a through opening, or a self-supporting transfer element, such as a patch or a label, which after being produced is applied to a value document.

A special role in authentication assurance is played by security elements with viewing angle-dependent effects, because these cannot be reproduced even with the most modern copiers. The security elements are equipped here with optically variable elements which convey a different pictorial impression to the viewer from different viewing angles, showing for example a different color impression or brightness impression and/or a different graphic motif depending on the viewing angle.

For this purpose, there has been proposed in the print WO 2008/049533 A2 a see-through security element with at least one microstructure with an appearance that is viewing angle-dependent in transmission, wherein the at least one microstructure is formed from an arrangement of a multiplicity of structure elements with a characteristic structure spacing of 1 μm or more and wherein the see-through security element has a total thickness of 50 μm or less.

On these premises, the invention is based on the object of stating a generic security element which, on the one hand, is thin enough to be able to be used in the security-paper and value-document sector and which, on the other hand, has not only high forgery resistance but also a visually attractive appearance, in order to be perceived, heeded and remembered as a security feature by the user.

SUMMARY OF THE DISCLOSURE

According to the invention, a generic security element contains at least one motif image which, through the viewing angle-dependent visual appearance of the microstructure, is visible in transmission from certain viewing angles, and invisible in transmission from other viewing angles, and wherein the microstructure and the motif image together have a thickness of 50 μm or less.

As to be explained more precisely hereinafter, the microstructure and the motif image can, within the framework of the invention, be arranged directly one over the other as well as be separated by intermediate layers, in particular by the substrate of a data carrier. In the latter case, the total thickness of microstructure, intermediate layers and motif image is normally above 50 μm, typically about 150 μm to 200 μm. The great total thickness comes from the intermediate layer or layers, however, while the sum of the thicknesses of microstructure and motif image is also always smaller than 50 μm in these variants, so that the security element of the invention only makes a small contribution to the total thickness of the data carrier.

At least one microstructure of the security element is advantageously formed here by a lamella structure consisting of a multiplicity of substantially parallel extending lamellae. The lamella structure may be e.g. a parallelogram structure. However, at least one lamella structure is preferably formed by a partly metallized asymmetric sawtooth structure with metallized first, less strongly inclined flanks and with non-metallized second, more strongly inclined flanks.

The first, less strongly inclined flanks preferably have an angle of inclination between 10° and 60°, based on the plane of the security element. The second, more strongly inclined flanks preferably have an angle of inclination between 50° and 110°, based on the plane of the security element, whereby the angles of inclination of the two flanks advantageously differ by at least 20°, preferably by at least 30°, in particular by at least 40°.

In a development of the invention, there are provided several microstructures formed by lamella structures, which differ in one or several of the parameters of lateral orientation, color, width, height, relief form and spacing. Preferably, the differing lamella structures are arranged in the form of a motif, in particular in the form of patterns, characters or a coding, and thus form a further motif in the security element. The motif of the lamella structures and at least one motif image of the security element are advantageously mutually coordinated or mutually related. For example, the lamella-structure motif and the motif image can represent the same motif, or can respectively represent only motif parts which complement each other to form a total information item in transmission from certain viewing angles.

Advantageously, the structure elements are provided in partial regions with an opaque coating, in particular an opaque metallic coating. The opaque coating can comprise in particular the above-mentioned lamellae on an asymmetric sawtooth structure.

The opaque coating can be configured to be single-layer or multi-layer and especially advantageously as a thin-film element with a color-shift effect, i.e. in optically variable fashion. As an example of single-layer thin-film elements there are primarily to be mentioned coatings of so-called pearl luster pigments. Multi-layer thin-film elements are generally configured as purely dielectric thin-film structures or metallic/dielectric multi-ply structures. Among multi-layer thin-film elements, those particularly preferred at present are three-layer interference-layer constructions (metallic/dielectric three-ply structure).

In an advantageous variant of the invention, the security element has a transparent or translucent substrate, whereby the at least one microstructure and the motif image are arranged on opposing surfaces of the substrate. The substrate need not be transparent or translucent over the full area for this purpose; a transparent or translucent window region in an otherwise opaque substrate is sufficient. In this variant of the invention, the security element constitutes a see-through security element.

Within the framework of the present invention a "transparent" material is understood to be a material that substantially completely passes incident electromagnetic radiation at least in the visible wavelength range of approx. 380 nm to approx. 780 nm. In a "transparent" material within the framework of the present invention the transmittance is $T \geq 0.8$, where T is defined as the ratio of radiated power L passed through the material to the radiated power $L_o$ irradiated onto the substrate. This exact definition of transmittance ($T=L/L_0$) corresponds to the definition given in "Lexikon der Optik", Spektrum Akademischer Verlag, Heidelberg 2003, Vol. 2, page 366, term "Transmittance".

An "opaque" or "non-transparent" material has within the framework of the present invention a transmittance $T \leq 0.1$, where T is defined as the ratio $L/L_0$ (see above). Within the framework of the present invention an opaque material hence substantially does not pass incident electromagnetic radiation at least in the visible wavelength range of approx. 380 nm to approx. 780 nm.

A "translucent" or "semi-transparent" material has within the framework of the present invention a transmittance T greater than 0.1 and smaller than 0.8, i.e. $0.1<T<0.8$, at least in the visible wavelength range of approx. 380 nm to approx. 780 nm.

As to be explained more closely below, the subjective perception of a transparent, translucent or opaque material by a viewer can sometimes deviate considerably from the exact definition of transparent, translucent or opaque material given above. In measurement series with metallized and non-metallized foils with and without diffractive structures which led to the specification of the above-mentioned transmittances for transparent, translucent and opaque materials, it was in fact ascertained that the subjective perception of a transparent, translucent or opaque material depends very strongly on the lighting situation, i.e. on whether the material is being viewed by the viewer in reflection, transmission or in a combination of reflection and transmission. Thus, a viewer might still perceive a security element as transparent even when the transmittance of the security element amounts to more than e.g. 0.7, i.e. less than 30% of the incident light is reflected or absorbed. Also, it is normally sufficient e.g. in the embodiments described below comprising an etching step on a metal layer in their manufacture when the layer thickness of the metal layer is reduced by the etching operation to a layer thickness appearing transparent to the viewer. Such a metal layer appearing transparent to the viewer might then be a translucent material according to the definition given above ($0.1<T<0.8$).

A similarly great influence on a viewer's subjective perception is furthermore exerted by the light scattering of the viewed material, because scattering influences, inter alia, the contrast between light and dark regions of the viewed material.

Independently of the possible difference between a viewer's subjective perception and the above definitions of transparent, translucent and opaque materials, all variants of the invention described within the framework of this application are workable, i.e. can be reworked without any problems by the person skilled in the art.

In an alternative, likewise advantageous variant of the invention, the security element has a transparent or translucent substrate, whereby the at least one microstructure and the motif image are arranged on the same surface of the substrate. Here, too, the substrate need not be transparent or translucent over the full area for producing a see-through security element; a transparent or translucent window region in an otherwise opaque substrate is sufficient.

In a further variant of the invention, the security element has an opaque substrate, whereby the at least one microstructure and the motif image are arranged on the same surface of the opaque substrate. The security element, in this variant of the invention, forms a reflective security element for plan viewing.

In the configuration as a see-through security element there can basically be employed any transparent or translucent substrate. The light transmission here must be at least so great that the viewing angle-dependent appearance can be perceived by the viewer in transmitted light. One might use an additional illumination means for improving the recognizability of the appearance by the viewer, although the thickness of the material is so chosen according to the invention that the optically variable appearance of the see-through security element is recognizable even without aids.

A basically suitable substrate is therefore paper, in particular cotton paper. There can of course also be used paper containing a proportion x of polymeric material in the range of $0 \leq x \leq 100$ wt %. However, it is particularly preferable when the substrate is a plastic, in particular a plastic foil, e.g. a foil of polyethylene (PE), polyethylene terephthalate (PET), polybutylene terephthalate (PBT), polyethylene naphthalate (PEN), polypropylene (PP) or polyamide (PA). The foil can further be stretched uniaxially or biaxially. The stretching of the foil leads, inter alia, to it acquiring polarizing properties which can be utilized as a further security feature. The aids required for exploiting these properties, such as polarization filters, are known to the person skilled in the art.

The substrate can also be configured as a multi-layer composite, in particular a composite of several different foils (compound composite) or as a paper/foil composite. The foils of the composite can be formed here e.g. from the above-mentioned plastic materials. Such a composite is characterized by an exceptionally great stability, which is of great advantage for the durability of the security element. Also, these composite materials can be used to great advantage in certain climatic regions of the earth.

In a particularly preferred variant of the invention, the paper/foil composite has an interior base paper and two exterior foil plies, as described more precisely in the print EP 1 545 902 B1, whose disclosure is incorporated in the present description to this extent. Also advantageous is the inverse construction of a paper/foil composite, wherein an interior foil is provided with two exterior paper plies.

All materials used as a substrate can have accessory agents which serve as further authentication features. Prime ones to be considered here are luminescent substances which are preferably transparent in the visible wavelength range and can be excited in the invisible wavelength range by a suitable aid, e.g. a radiation source emitting UV or IR radiation, to produce a visible or at least detectable luminescence. The lacquers or inks used for a microstructure or the motif image can of course also have the above-mentioned accessory agents.

If the microstructure and the motif image are arranged on opposing surfaces of the substrate, they are mutually separated at least by the substrate. The total thickness of microstructure, substrate and motif image is then typically above 50 μm, for example 150 μm to 200 μm, even if the sum of the thicknesses of microstructure and motif image is smaller than 50 μm. With a multi-layer substrate, for example a compound composite or a paper/foil composite, this offers the additional advantage that the security element is necessarily destroyed upon a splitting of the composite and is hence not available for reuse.

In other designs, the at least one microstructure can advantageously be arranged directly on the motif image.

In all designs, the motif image can comprise a printed or embossed motif structure, a structured metal layer, a color-shifting motif layer, a diffractive motif layer, such as a hologram, a structured multi-layer structure, a structured sub-wavelength grating, a moth-eye structure, a printed structure, a layer with negative patterns, such as negative characters, or a combination of the stated variants.

According to a development of the invention, the security element contains a second motif image which is applied to at least one microstructure, so that only the first motif image is visible in transmission from certain viewing angles and only the second motif image from other viewing angles. The second motif image can be formed in particular by a structured metal layer, a color-shifting motif layer or also by a structured printed layer. Because the second motif image is applied to a microstructure, it is normally recognizable not only in transmission, but also in plan viewing. In a variant, a combination of the first and second motif images can also become visible from certain viewing angles.

The first and second motif images can be mutually coordinated or mutually related with their visual appearance or their information content. For example, the two motif images can represent the same motif in different design (e.g. in color in plan viewing but black and white in transmission), or they can respectively represent only motif parts which complement each other to form a total motif. Such a visual or content-based interaction increases the attention value and recognition value of the safeguarding means, on the one hand, and leads to elevated forgery resistance, on the other hand, because producing motif images mutually linked in terms of content constitutes a greater technological hurdle than producing two security features separately or without a link in terms of content.

The microstructure and the motif image preferably have together a thickness of 20 μm or less, particularly preferably from 3 μm to 10 μm. The structure elements of the microstructure expediently have a characteristic structure spacing of 5 μm or more. Further, it is provided according to an advantageous design that the structure elements respectively have a structure size of 1 μm or more, preferably 3 μm or more. The structure spacing of 1 μm or more, or the structure size of 1 μm or more, ensures that the microstructures appear largely achromatic, i.e. without spurious color splitting. Hence, the optically variable effects can be recognized without any problems even under unfavorable lighting conditions.

The arrangement of a multiplicity of structure elements according to the invention may be an arrangement that is regular, irregular or regular in some regions. The invention thus embraces any arrangement of a multiplicity of structure elements that has a structure spacing of 1 μm or more. Advantageously, the structure elements are arranged substantially periodically, whereby the period given by the characteristic structure spacing is superimposed by a random fluctuation of the structure spacings with an amplitude between 1% and 5%, in particular of about 2%, of the period, in order to almost entirely suppress unwanted color splitting through diffraction effects on periodic structures.

For the profile of the structure elements, height-to-width ratios of about 9:1 to about 1:5 are considered advantageous, and of about 1:3 to about 8.2:1 especially advantageous.

In a special variant of the invention, it is provided that in the motif image of the security element a predetermined motif to be represented is distorted, and the motif image and at least one microstructure are mutually coordinated such that the motif to be represented is visible undistorted in transmission at a predetermined curvature of the security element.

The security element can be configured as a transfer element for transfer to a target substrate, in particular to a security paper, value document or the like.

The invention also comprises a method for manufacturing a security element of the described type, wherein the security element is provided with at least one microstructure with a visual appearance that is viewing angle-dependent in transmission, wherein the at least one microstructure is formed from an arrangement of a multiplicity of structure elements with a characteristic structure spacing of 1 m or more, wherein the security element is provided with at least one motif image which is visible in transmission from certain viewing angles, and invisible in transmission from other viewing angles, and wherein the security element is produced with a thickness of microstructure and motif image together of 50 μm or less.

At least one microstructure of the security element is advantageously formed here by a lamella structure consisting of a multiplicity of substantially parallel extending lamellae.

For the production of the lamella structure there can be employed within the framework of the invention different technologies, for example an oblique vapor deposition of the lamellae, in particular of the flanks of a sawtooth structure, a vertical vapor deposition, followed by an etching step, or also an oblique vapor deposition in connection with a subsequent etching step. It is provided here in an advantageous method variant for producing at least one lamella structure that an embossing lacquer layer is applied to a substrate, the embossing lacquer layer is embossed and hardened in the form of a lamella structure with a multiplicity of substantially parallel extending lamellae, in particular of an asymmetric sawtooth structure with first, less strongly inclined flanks and with second, more strongly inclined flanks, the lamella structure, in particular the sawtooth structure, is coated with a metallization over the full area, the metallization is etched by an etching operation, whereby the etching operation is ended as soon as the metallization present on the lamellae, in particular on the more strongly inclined flanks, is reduced to a preselected layer thickness appearing transparent, or is completely etched through.

The metallization can be etched in particular isotropically in the etching operation. Etching methods that might be used here are physical etching methods, such as plasma etching, ion etching, ion beam etching, reactive plasma etching or atmospheric plasma etching. Chemical etching methods employing acids or bases can also be used.

The coating of the sawtooth structure can be effected in particular by chemical coating, vapor deposition, sputtering, plasma-enhanced vapor deposition, by CVD or by printing on metal particles. If the metallization is vapor-deposited, the vapor deposition can in particular also be effected vertically, as to be explained more precisely below.

The invention further comprises a data carrier, in particular a value document, such as a bank note, an identification card or the like, which is equipped with a security element of the described type or with a security element manufactured by the above-described method.

Further, the invention comprises a method for manufacturing a data carrier, in particular a value document, such as a bank note, identification card or the like, wherein a data-carrier substrate is made available, and a security element of the described type is applied to the data-carrier substrate or incorporated into the data-carrier substrate.

For creating a see-through security element, the data-carrier substrate can have a see-through region and the security element be applied to the data-carrier substrate, or incorporated into the data-carrier substrate, in the see-through region.

The invention also comprises a method for manufacturing a data carrier, in particular a value document, such as a bank note, identification card or the like, wherein a data-carrier substrate is made available, the data-carrier substrate is provided with at least one motif image, and the data-carrier substrate is provided in the region of the at least one motif image with at least one microstructure with a visual appearance that is viewing angle-dependent in transmission which is formed from an arrangement of a multiplicity of structure elements with a characteristic structure spacing of 1 μm or more, so that the at least one microstructure and the at least one motif image form a security element wherein the microstructure and the motif image together have a thickness of 50 μm or less and wherein the motif image is visible in transmission from certain viewing angles and invisible in transmission from other viewing angles.

Through the described measures it is ensured that the security elements of the invention are thin enough to also be usable in the value-document sector, and that they can also be manufactured economically in the required high numbers of pieces by the proposed methods. The security element can also be applied here in two separate parts (microstructure and motif image), for example on opposing sides of a bank-note substrate. Through its viewing angle-dependent visual impression and the see-through nature of the microstructure, the security element cannot be reproduced even with modern copiers. The additional motif image which is visible in transmission from certain viewing angles but invisible from other viewing angles gives the security element, possibly in interaction with a further motif applied to the microstructure, an attractive visual appearance and a high attention value and recognition value.

DESCRIPTION OF THE DRAWINGS

Further embodiment examples as well as advantages of the invention will be explained hereinafter with reference to the figures, in whose representation a rendition that is true to scale and to proportion has been dispensed with in order to increase the clearness. The different embodiment examples are not limited to employment in the concretely described form, but can also be combined with each other.

It is evident that the completely sharp profiles of the sawtooth structures and lamellae as shown in the figures represent an idealization of the actual conditions. In practice, the transitions on the flanks of the lamellae are of course rounded to a certain degree and not discontinuous.

Figure 1:
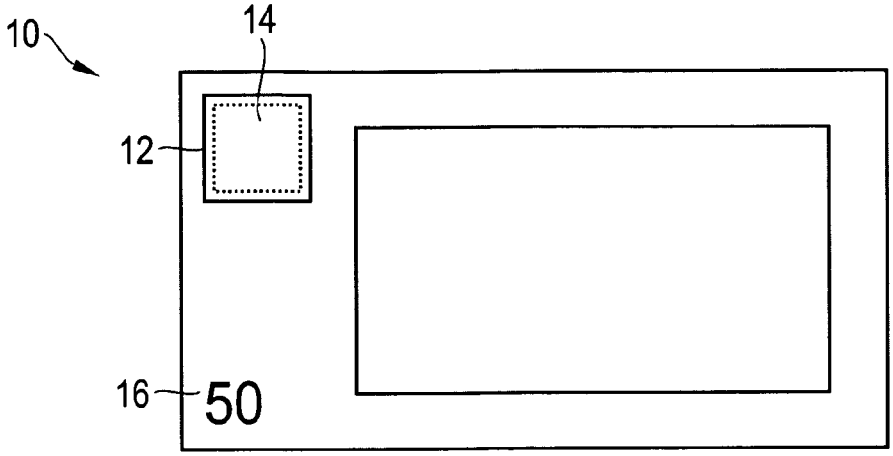
Figure 2A:
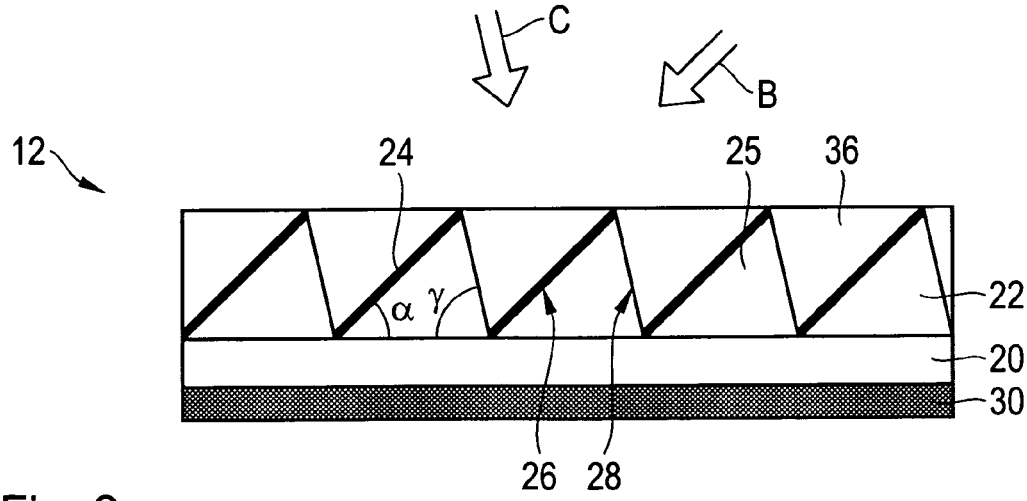
Figure 2B:
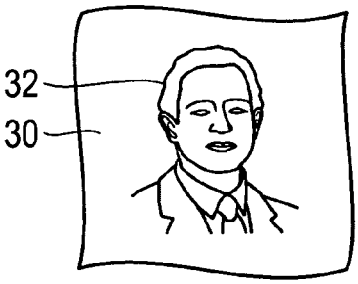
Figure 2C:
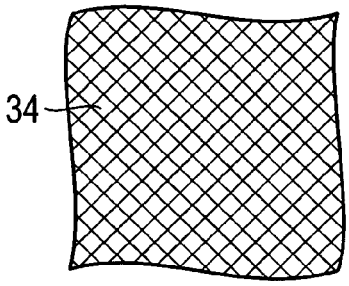
Figure 5:
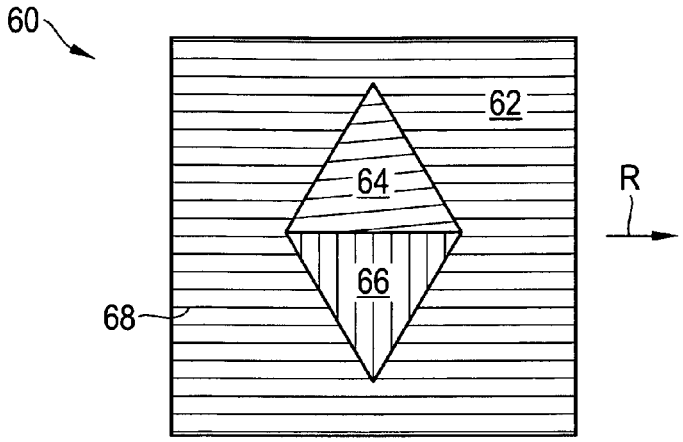
Figure 6A:
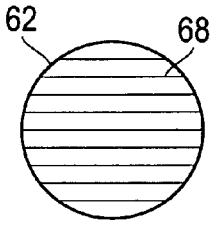
Figure 6B:
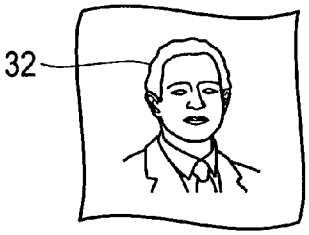
Figure 6C:
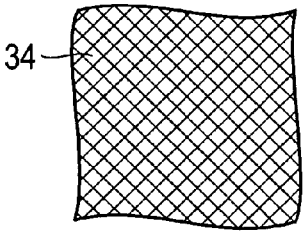
Figure 7A:
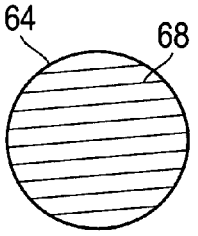
Figure 7B:
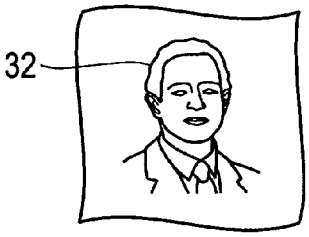
Figure 7C:
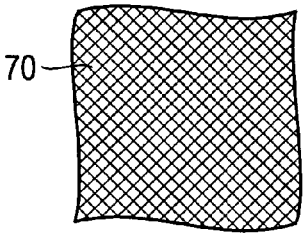
Figure 8A:
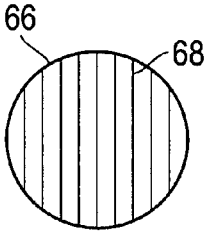
Figure 8B:
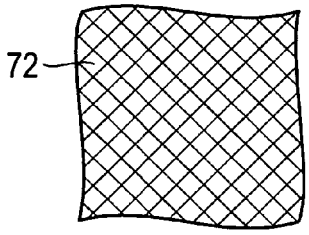
Figure 8C:
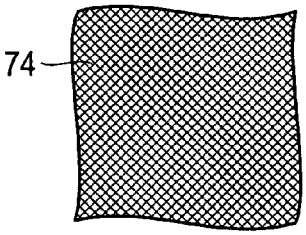
Figure 9A:
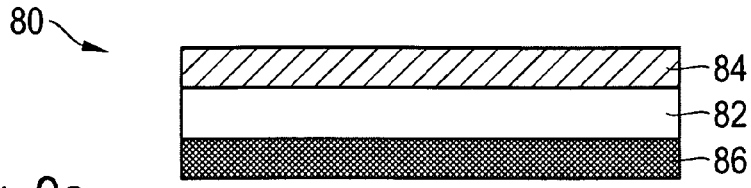
Figure 9B:
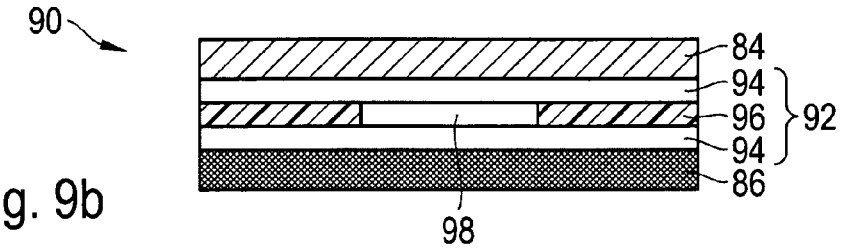
Figure 9C:
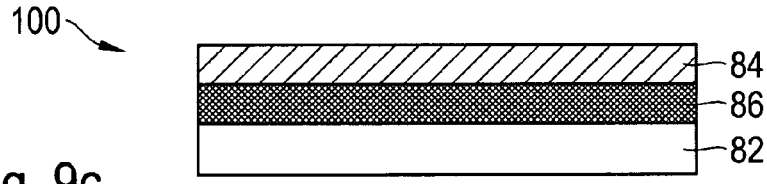
Figure 9D:
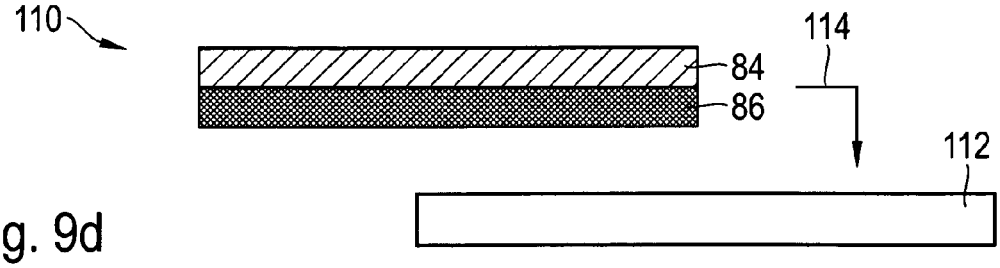
Figure 9E:
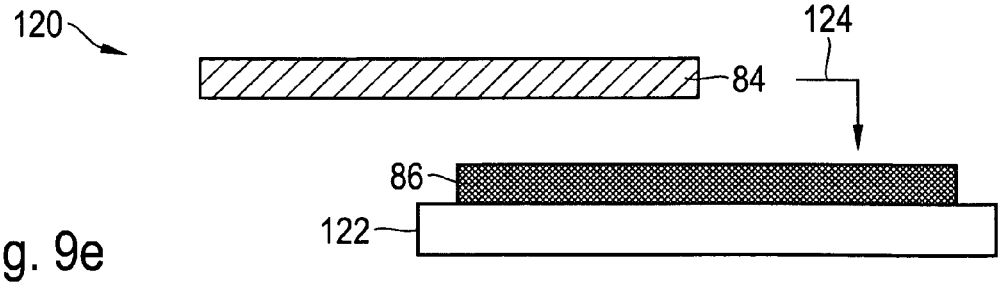
Figure 10A:
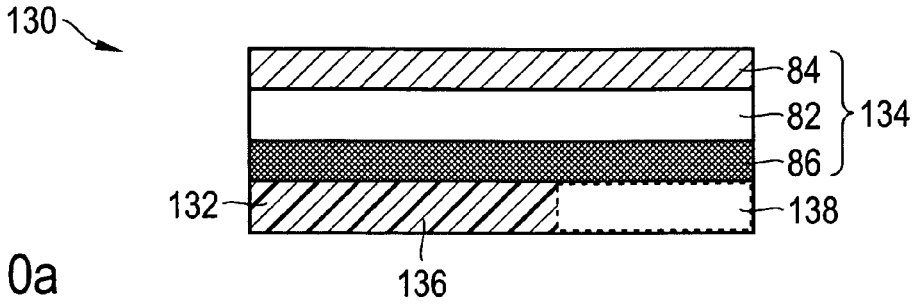
Figure 10B:
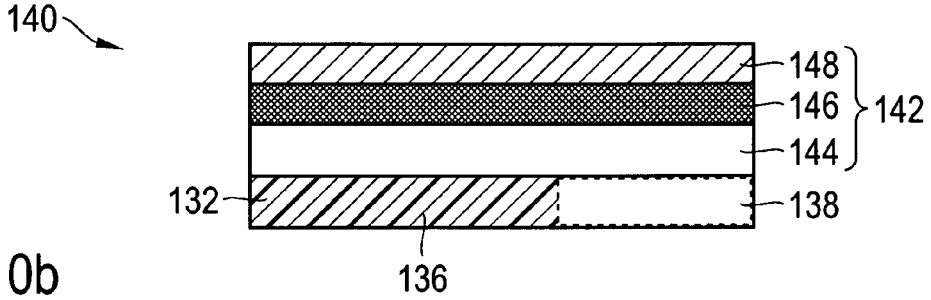
Figure 10C:
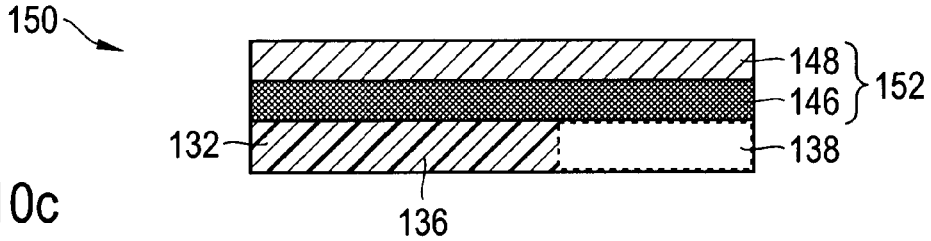
Figure 10D:
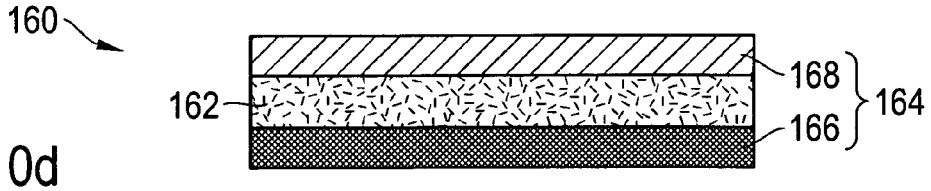
Figure 10E:
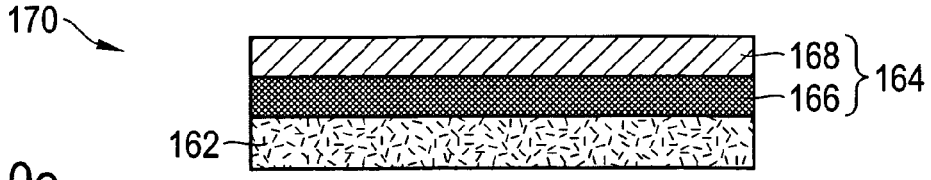
Figure 10F:
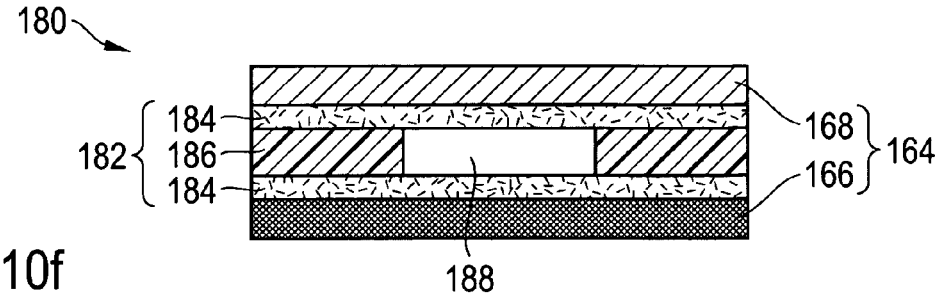
Figure 10G:
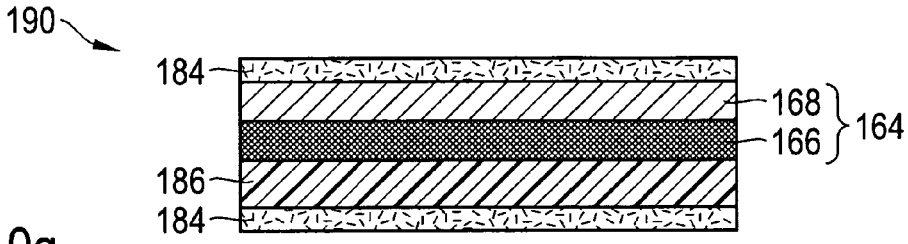
Figure 10H:
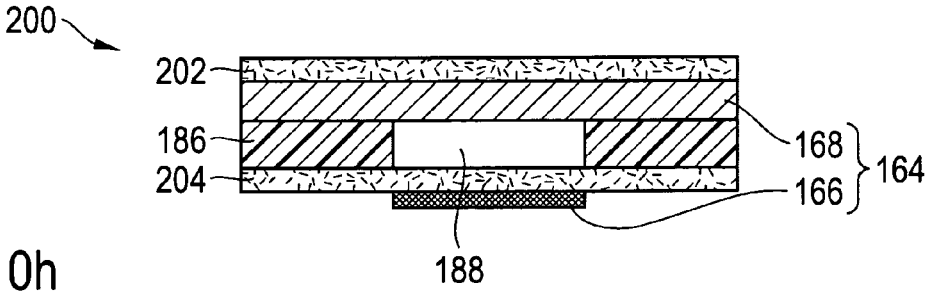
Figure 10I:
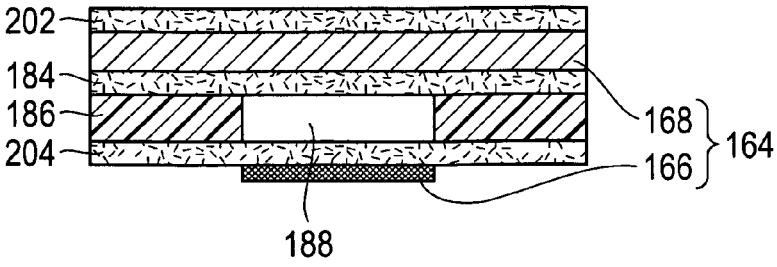

There are shown:

FIG. 1 a schematic representation of a bank note with a see-through security element according to the invention, FIGS. 2*a*-2*c* in (a) a cross section through a see-through security element according to the invention, in (b) the visual impression of the see-through security element from viewing direction B, and in (c) the visual impression of the see-through security element from viewing direction C, FIG. 3 an intermediate step in the manufacture of a security element according to the invention, FIGS. 4*a*-4*c* an embodiment example of the invention wherein the see-through security element contains besides the motif image a second motif image, whereby (a) shows a cross section through the see-through security element, (b) the visual impression of the see-through security element from viewing direction B, and (c) the visual impression of the see-through security element from viewing direction C, FIG. 5 a schematic plan view of a see-through security element with three regions with different lamella orientation, FIGS. 6*a*-6*c* in (a) the first region of FIG. 5 with the orientation of the lamellae, in (b) the visual impression of the first region upon viewing parallel to the lamellae of the first region, and in (c) the visual impression of the first region upon viewing perpendicular to the lamellae of the first region, FIGS. 7*a*-7*c* in (a) to (c) a representation as in FIG. 6 for the second region of FIG. 5, whereby (b) shows the visual impression of the second region upon viewing parallel to the lamellae of the first region, and (c) the visual impression of the second region upon viewing perpendicular to the lamellae of the first region, FIGS. 8*a*-8*c* in (a) to (c) a representation as in FIG. 6 for the third region of FIG. 5, FIGS. 9*a*-9*e* in (a) to (e) security elements according to the invention with different arrangements of microstructure and motif image relative to each other, and FIGS. 10*a*-10*i* in (a) to (i) embodiment examples of value documents according to the invention.

DETAILED DESCRIPTION OF PREFERRED EMBODIMENTS OF THE INVENTION

The invention will now first be explained by the example of see-through security elements for bank notes. FIG. 1 thus shows a schematic representation of a bank note 10 with a see-through security element 12 with a Venetian-blind image which is arranged over a see-through region 14, e.g. a window region or a through opening of the bank note 10. The through opening can be produced e.g. by punching or laser beam cutting after the manufacture of the substrate of the bank note 10, or can already be produced during the manufacture of the bank-note substrate, as described for example in the print WO 03/054297 A2, whose disclosure is incorporated in the present application to this extent.

The see-through security element 12 shows the viewer a different visual appearance depending on the viewing direction. In the embodiment example, the security element 12 appears metallically lustrous over the full area from certain viewing angles, while after a tilting or rotation of the bank note a graphic motif in the form of a portrait appears in transmission from other viewing angles.

An important property for the use of the see-through security element 12 in bank notes or other papers of value is its small total thickness of less than 50 μm. Preferably, the see-through security element even has a layer thickness of only about 20 μm or even of only about 3 μm to 10 μm.

Moreover, the see-through security element 12 has not only high forgery resistance but also an attractive visual appearance, so that it is perceived, heeded and remembered as a security feature by the users. This is achieved according to the invention by the combination of a microstructure which has a visual appearance that is viewing angle-dependent in transmission, with at least one motif image which is visible in transmission only from certain viewing angles but hidden from other viewing angles.

Referring to the cross section FIG. 2(*a*), the security element 12 thus has a transparent foil substrate 20 whose upper side is provided with a transparent lacquer layer with an asymmetric sawtooth structure 22. The sawtooth structure 22 is partly metallized, so that it forms a lamella structure consisting of a multiplicity of substantially parallel extending, metallic lamellae 24. As to be seen in FIG. 2(*a*), the lamellae 24 are formed by a metallization of little inclined flanks 26 of the sawtooth structure 22. The little inclined flanks 26 and thus also the metallic lamellae 24 enclose an angle $\alpha$ with the surface of the foil/foil substrate 20 that is typically between 10° and 60°, being $\alpha$=30° in the embodiment example.

The sawtooth structure 22 in addition also contains strongly inclined flanks 28 which enclose an angle $\gamma$ with the surface of the foil/foil substrate 20 that is considerably greater than the angle $\alpha$ of the little inclined flanks 26 and that is typically between 50° and 90', being $\gamma$=80° in the embodiment example. The strongly inclined flanks 28 are not metallized, so that the viewer can see through the sawtooth structure 22 at a viewing direction approximately perpendicular to the flanks 28 (viewing direction B).

The lamellae 24 are characterized by the parameters of lateral orientation, color, width, height, relief form, in particular angle of inclination, and spacing of the lamellae. For example, the lamellae 24 in the embodiment example of FIG. 2(*a*) have an angle of inclination of $\alpha=30°$, a spacing of about 10 μm, a width of about 5.5 μm and a height of about 4.3 μm. The color of the lamellae results from the metal employed for the metallization, for example aluminum, whereby the layer thickness of the aluminum layer is about 70 nm in the embodiment example of FIG. 2(*a*).

As mentioned above, the completely sharp profiles of the sawtooth structure 22 and of the lamellae 24 in the figures involve an idealized representation. In real embossed structures the transitions on the flanks 26, 28 of the lamellae are of course rounded to some degree and not discontinuous. The sawtooth structure 22 and the lamellae 24 are further protected against casting and against environmental influences by an embedding 36, for example a transparent lacquer layer. For clarity's sake the embedding 36 is no longer represented in the further figures.

In the simplest case, only one lamella structure with a uniform parameter set is provided in the see-through security element. However, more complex designs can also use several lamella structures with different lamella parameters, as illustrated for example in FIGS. 5 to 8 for the parameter "lateral orientation".

On the underside of the foil substrate 20 there is arranged a motif image 30 which can represent a graphic motif, such as the portrait 32 shown in FIG. 2(*b*), a geometrical pattern or a character string.

Upon viewing of the security element 12 substantially parallel to the lamellae 24, i.e. in direction B of FIG. 2(*a*), the viewer looks at the non-metallized flanks 28, so that the sawtooth structure 22 appears substantially transparent in transmission. For the viewer the graphic motif 32 of the motif image 30 is hence visible from this viewing direction, as represented in FIG. 2(*b*).

However, when the security element 12 is viewed from viewing direction C, i.e. substantially perpendicular to the metallic lamellae 24, the lamellae 24 obstruct the view-through onto the motif image 30 for the viewer. The portrait 32 is hidden to the viewer from these viewing angles and the security element 12 appears as an opaque, metallically lustrous area 34, as represented in FIG. 2(*c*).

To obtain the selective metal coating 24 of only the little inclined flanks 26 of the sawtooth structure 22, one can proceed for example as follows:

Referring to FIG. 3, a UV embossing lacquer layer is first applied to the substrate 20. The embossing lacquer layer is embossed and hardened in the form of the desired, asymmetric sawtooth structure 22 with first, less strongly inclined flanks 26 and with second, more strongly inclined flanks 28. Subsequently, the sawtooth structure 22 is provided by a vertical vapor deposition over the full area with a metallization 40, in the embodiment example an aluminum metallization. Due to the different angles of inclination of the flanks 26 and 28 this results in different thicknesses for the aluminum metallization 40 on the flanks. If d designates the layer thickness of the applied metallization on a plane surface, there results on the flanks 26 with angle of inclination α a layer thickness $$d_\alpha=d*\cos(\alpha)$$

and on the flanks 28 with angle of inclination γ a layer thickness $$d_\gamma=d*\cos(\gamma).$$

For example, at a plane layer thickness d=100 nm and angles of inclination $\alpha=30°$ and $\gamma=80°$ there result for the layer thicknesses $d_\alpha=87$ nm and $d_\gamma=17$ nm. This corresponds to the intermediate stage of manufacture shown in FIG. 3, whereby the layer thickness $d_\gamma$ has been represented with exaggerated thickness in relation to the layer thickness $d_\alpha$ in order to ensure its recognizability.

Then the metallization 40 is etched isotropically by an etching step, whereby the etching step is terminated as soon as the metallization 40 present on the strongly inclined flanks 28 is etched through. The etching step can be effected for example with a mixture of phosphoric acid, acetic acid and nitric acid at constant temperature of the etching solution, whereby for an optimal etch start the aluminum oxide of the metallization 40 is first removed with concentrated phosphoric acid. It is evident that other etching solutions and also bases, such as NaOH, can also be employed for the etching step.

The ending of the etching step can be defined in terms of time, whereby the termination is effected through neutralization at the end of the etching time. If, in the above-mentioned example, the etching step is ended after the metallization of the strongly inclined flanks 28 is etched through, there remains on the little inclined flanks 26 a metallization with a thickness of $d_\alpha=70$ nm and on the strongly inclined flanks 28 a metallization with the thickness $d_\gamma=0$, as represented in FIG. 2(*a*).

The etching can be supported mechanically, for example with brushes or high-pressure nozzles. The etching step need not be effected by a wet chemical process; the metallization 40 can for example also be removed by a directed etching beam. For good results it is of advantage for there to be a great difference between the angles of inclination α and γ of the two flanks 26, 28. The two angles of inclination preferably differ by at least 20°, preferably by at least 30°, in particular by at least 40°.

The metallization 40 present on the strongly inclined flanks 28 need not necessarily be completely etched through to obtain the desired difference in transparency or opacity. Thus, a region is normally already felt by the viewer to be fully reflective when 85% of the incident light is reflected, and still felt to be transparent even when a small proportion of less than 20% is reflected. The exact numerical values here depend on the employed metal, the ground and the illumination. Hence, in some designs it is sufficient to thin the metallization 40 on the strongly inclined flanks 28 to such an extent that the remaining metal layer is perceived by the viewer as transparent, while at the same time the remaining metal layer on the little inclined flanks 26 is perceived as fully reflective.

For example, an aluminum layer has a reflectance of more than 80% of maximum reflectance above a layer thickness of about 12 nm, and a reflectance of less than 20% of maximum reflectance below a layer thickness of about 2.5 nm. Hence, it is sufficient to mutually coordinate the angles of inclination α and γ of the two flanks 26, 28, the plane layer thickness d and the etching process in such a way that the resulting layer thickness $d_\alpha$ on the little inclined flanks 26 is greater than 12 nm and the resulting layer thickness $d_\gamma$ on the strongly inclined flanks 28 is below 2.5 nm.

Accordingly, a copper layer or a gold layer has a reflectance of more than 80% of maximum reflectance above a layer thickness of about 40 nm, and a reflectance of less than 20% of maximum reflectance below a layer thickness of about 12 nm. A chromium layer has a reflectance of more than 80% of maximum reflectance above a layer thickness of about 18 nm, and a reflectance of less than 20% of maximum reflectance below a layer thickness of about 5 nm. Hence, the two angles of inclination, the plane layer thickness and the etching process can also be mutually coordinated accordingly by the person skilled in the art when employing these or also other metals.

Through the use of the stated etching process for the flanks with different degrees of inclination it is possible to produce oblique metallic lamellae 24 without requiring an oblique vapor deposition of the sawtooth structure 22. The described method is independent of the motif image 30 and can also be used in designs in which the lamella structure is not combined with a motif image. The employment of the etching method also allows several viewing directions to be realized for a transparency. The etching method is moreover independent of the orientation of the sawtooth structure. Although the etching method is applied especially advantageously in connection with a vertical vapor deposition of the sawtooth structure, it can of course basically also be used in connection with an oblique vapor deposition.

FIG. 4 shows a development of the invention in which the see-through security element 12 contains besides the motif image 30 a second motif image 50. As shown in the cross section of FIG. 4(*a*), the second motif image 50 is formed by a structured metallic coating 52 which is applied to the metallic lamellae 24 of the sawtooth structure 22 and formed from metal contrasting in color with the lamellae 24. In the embodiment example of FIG. 4 the color contrasting metals chosen are aluminum for the lamellae 24 and copper for the second motif image 50, 52, but other metal combinations of course also come into consideration, such as gold and chromium.

From the two metallic coatings applied one over the other, the upper metal is removed in certain places in order to produce the second motif image as a bimetal motif. This can be effected for example using the washing method based on printing on a soluble printing ink with a porous structure as described in the print WO 99/13157, by lift-off, or by later selective etching. When using an etching method one can also work with an etch stop layer.

In the embodiment example of FIG. 4, the copper metallization 52 is structured in the form of the numeric string "50" which at the same time represents the denomination 16 of the bank note 10 (FIG. 1).

The additional copper metallization 52 does not alter the visual impression of the security element 12 upon viewing parallel to the lamellae 24 (viewing direction B). Only the graphic motif 32 of the motif image 30 is visible to the viewer from this viewing direction, as shown in FIG. 4(*b*), but not the bimetal motif. When the security element 12 is viewed from the viewing direction C, however, the viewer looks at the bimetal motif "50" which is formed by the copper metallization 52 and the aluminum lamellae 24. The opaque metallic lamellae 24 obstruct the view of the motif image 30, so that only the bimetal motif "50" is visible from viewing direction C, but not the portrait 32, as represented in FIG. 4(*c*).

When the security element 12 or the bank note 10 is tilted back and forth, the visual impression changes between the portrait and the numeric string "50". The numeric string "50" appears here as a bimetal motif, copper on aluminum, while there is practically no restriction with regard to color choice for the portrait apart from its nature as a see-through element. Altogether, the see-through security element of FIG. 4 thus contains three visual information items or effects for the viewer. The first information item or effect is formed by the per se known Venetian-blind effect, which is based on the partly opaque coating of the asymmetric sawtooth structure 22. The second information item or effect is formed by the bimetal motif of the numeric string "50" which is visible only from certain viewing angles (viewing direction C), and the third information item or effect is formed by the portrait 32 which is visible only from other viewing angles (viewing direction B).

The second motif image can also be formed by a structured thin-film element 52 with a color-shift effect. For this purpose there is for example applied to the sawtooth structure 22 a three-layer optically variable coating consisting of an aluminum reflective layer, a dielectric spacer layer and a semi-transparent chromium absorber layer. Only the aluminum reflective layer must be applied to the little inclined flanks 26 by oblique vapor deposition here. The dielectric spacer layer and the semi-transparent chromium layer can be applied by vertical vapor deposition as well as by oblique vapor deposition. The absorber layer is then removed in certain places by one of the above-mentioned methods, thereby creating regions without a color-shift effect against a color-shifting background, which form the second motif image in the form of graphic motifs, patterns or characters.

The same optical effect can be achieved when not only the absorber layer but also the dielectric spacer layer is removed in certain regions.

In other designs, the structured coating 52 applied to the lamellae 24 can also be formed by a printed layer.

The lamella structures are, within the framework of the invention, advantageously formed respectively from a multiplicity of substantially parallel extending lamellae 24, as shown e.g. in FIG. 2(*a*). The underlying sawtooth structure 22 has alternatingly rising, little inclined flanks 26 and falling, strongly inclined flanks. The sawteeth 25 respectively formed by a flank pair 26, 28 represent here the structure elements of the lamella structure, their dimension represents the structure size, and the spacing of neighboring sawtooth points the characteristic structure spacing. The characteristic structure spacing is 5 μm or more within the framework of the invention, and the structure size 1 μm or more. In the embodiment example of FIG. 2(*a*), the structure size and the structure spacing respectively amount to 10 μm for example, the height of the structure elements amounts to about 4.3 μm.

In practice it has turned out to be advantageous not to choose the structure spacing to be completely constant, even with a desired periodic arrangement of the structure elements, but rather to superimpose it with a random fluctuation in order to effectively suppress wavelength-dependent diffraction effects and thus unwanted color splitting. For this purpose there normally suffices a fluctuation amplitude between 1% and 5% of the structure spacing. In the embodiment example, the desired structure spacing of 10 μm is superimposed by a random fluctuation of 2%, i.e. of 0.2 μm, thereby obtaining a significant reduction of diffraction effects.

In further embodiments of the invention, the see-through security element contains besides the picture motif 30 of FIG. 2 an additional motif which is formed by a locally different orientation of the lamella structures. FIG. 5 schematically shows for this purpose a plan view of a see-through security element 60 with three regions 62, 64, 66 of different lamella orientation. In the first region 62 the lamellae 68 have a first orientation, for example parallel to a reference direction R, corresponding to an azimuth angle of 0°. In the second region 64 the lamellae 68 have a second orientation which differs only little from the first orientation and encloses for example an azimuth angle of 5° with the reference direction R. In the third region 66 the orientation of the lamellae 68 is strongly rotated against the reference direction, for example by an azimuth angle of 90°.

The regions 62, 64 and 66 are shown in FIGS. 6(*a*), 7(*a*) and 8(*a*) again with the orientation of their lamellae 68. FIGS. 6(*b*), 7(*b*) and 8(*b*) show the visual impression of the respective region upon viewing parallel to the lamellae 68 of the first region 62 (corresponding to viewing direction B in FIG. 2), and FIGS. 6(*c*), 7(*c*) and 8(*c*) the visual impression of the respective region upon viewing perpendicular to the lamellae 68 of the first region 62 (corresponding to viewing direction C in FIG. 2).

Referring first to FIG. 6, the sawtooth structure 22 of the first region 62 appears substantially transparent upon viewing of the security element 60 parallel to its lamellae 68, as already explained in connection with FIG. 2, so that the viewer sees the graphic motif 32 of the motif image 30 from this viewing direction, as represented schematically in FIG. 6(*b*). Upon viewing from viewing direction C, the lamellae 68 obstruct the viewer's view-through and the first region 62 appears to the viewer as an opaque, metallically lustrous area 34, as represented in FIG. 6(*c*).

Referring to FIG. 7, the sawtooth structure 22 of the second region 64 still appears practically completely transparent upon viewing of the security element 60 parallel to the lamellae 68 of the first region 62 due to the small azimuth angle of the lamellae 68 of the second region 64 of 5°, so that the viewer sees the graphic motif 32 of the motif image 30 also in the second region from this viewing direction, as schematically represented in FIG. 7(*b*). Upon viewing from viewing direction C, the lamellae 68 obstruct the viewer's view-through and the second region 64 appears to the viewer as an opaque, metallically lustrous area 70 which, however, has a contrast difference to the area 34 of the first region in reflection through the different orientation of the lamellae 68. This contrast difference is indicated in FIG. 7(*c*) by a hatching different to FIG. 6(*c*).

Referring finally to FIG. 8, the sawtooth structure 22 of the third region 66 no longer appears transparent upon viewing of the security element 60 parallel to the lamellae 68 of the first region 62 due to the great difference in the azimuth angle of 90°, so that the viewer sees in this region an opaque, metallically lustrous area 72, as shown in FIG. 8(*b*). Upon viewing from viewing direction C as well, the lamellae 68 obstruct the viewer's view-through, the third region 66 appearing to the viewer as an opaque, metallically lustrous area 74 which, through the different orientation of the lamellae 68, has a contrast difference to the area 34 of the first region as well as to the area 70 of the second region. This contrast difference is indicated in FIG. 8(*e*) by a hatching different to FIG. 6(*c*) and to FIG. 7 (*c*).

The portrait views 32 of FIGS. 6(*b*) and 7(*b*) only stand schematically for the visibility of the motif image in the first or second region, because in reality only the respective part of the motif image located below the region 62 or 64 is of course visible to the viewer. Hence, a coordination of the form and size of the regions 62, 64, 66 to the motif image renders it possible to make only certain respective parts of the motif image recognizable from certain viewing directions. In particular, the motif of the lamella structures 62, 64, 66 and the motif image 30 can be mutually coordinated in such a way that a total information item results in transmission from certain viewing angles.

The security elements of the invention need not be configured as see-through security elements, but can also, in particular on opaque substrates, be designed as reflective security elements for plan viewing. The arrangement of microstructure and motif image relative to each other can be effected in a variety of ways, as illustrated by the representations of FIG. 9. FIG. 9(*a*) first shows a security element 80 with a transparent or translucent substrate 82, a microstructure 84, for example in the form of a lamella structure of the above-described type, and a motif image 86. The microstructure 84 and the motif image 86 are arranged here on opposing surfaces of the substrate 82. The substrate 82 can be formed by a single foil which can also already be provided with different coatings, or also by a foil composite.

FIG. 9(*b*) shows a construction 90 similar to that of FIG. 9(*a*), wherein the microstructure 84 and the motif image 86 are arranged on opposing sides of a foil-composite bank note 92 which contains at least two foil plies 94 and a paper ply 96 with a window 98. Upon splitting of the foil-composite bank note 92 the security element is destroyed.

In the one-sided construction 100 of FIG. 9(*c*), the motif image 86 is arranged on the upper side of a transparent, translucent or opaque substrate 82, and the microstructure 84 lies directly over the motif image 86. In this variant, the substrate 82 serves only as a carrier of the security element and can optionally be removed later.

The security element can also be configured as a substrateless transfer element 110, as shown in FIG. 9(*d*). In this case as well, the microstructure 84 is arranged directly over the motif image 86. The transfer element 110 is typically applied to a target data carrier 112 in a later method step (reference sign 114). This can be done in a see-through region, for example a window or a through opening of the data carrier 112, or also in an opaque data-carrier region.

As represented in FIG. 9(*e*), it can also be provided here that the motif image 86 has already been applied to a data carrier 122 previously, and that the transfer element 120 with the microstructure 84 is subsequently applied to the data carrier 122 with the motif image 86 (reference sign 124).

The security elements of the invention can be arranged in a multiplicity of arrangements on value documents having a substrate of paper, polymer or hybrid, and over opaque as well as over transparent or translucent regions of the value document. For illustrating this variety, some particularly preferred embodiments will be described with reference to FIG. 10.

First, FIG. 10(*a*) shows as a value document 130 a paper bank note 132 to which a security element 134 according of the invention is applied. The security element 134 can act as a reflective security element over an opaque region 136 of the paper bank note 132 and/or as a see-through security element in an optional window region 138 of the paper bank note 132. The security element 134 here can have, for example, like the security element 80 of FIG. 9(*a*), a transparent or translucent substrate 82, a microstructure 84, in particular in the form of a lamella structure of the above-described type, and a motif image 86.

In the variant 140 of FIG. 10(*b*), there is applied to a paper bank note 132 a security element 142 according to the invention having a foil substrate 144, a motif image 146 and a microstructure 148. The foil substrate 144 can be opaque or transparent/translucent. In the case of an opaque foil substrate 144, only the use as a reflective security element comes into consideration. If the foil substrate 144 is at least translucent, however, the security element 142 can form a see-through security element in an optional window region 138 of the paper bank note 132 or form a reflective security element over an opaque region 136 of the paper bank note 132.

The security element can also be present as a substrateless security element 152 on the paper bank note 132, as shown in the variant 150 of FIG. 10(*c*). The motif image 146 and the microstructure 148 can form here a reflective security element in opaque regions 136 of the paper bank note 132 and/or a see-through security element in optional window regions 138 of the paper bank note 132.

If a value document 160 contains a pure polymer substrate 162, the security element 164 of the invention can also be arranged in two parts (motif image 166 and microstructure 168) on opposing sides of the polymer substrate 162 in a transparent or at least translucent region of the note, as represented in FIG. 10(*d*).

The motif image 166 and the microstructure 168 can also be arranged on the same side of the polymer substrate 162, as shown in the construction 170 of FIG. 10(*e*). In this case, the polymer substrate 162 can also be opaque in the region of the security element 164.

FIG. 10(*f*) shows a value document 180 which has a substrate 182 consisting of a paper/foil composite with a paper ply 186 with a window 188 and two foil plies 184. On opposing sides of the paper/foil composite 182 there are applied a microstructure 168 and a motif image 166 which together form a security element 164 according to the invention. Upon splitting of the paper/foil composite 182 the security element 164 is destroyed.

In the value document 190 of FIG. 10(*g*), the security element 164 with the microstructure 168 and the motif image 166 is applied to a paper ply 186 and embedded together with the paper ply 186 between two laminate foils 184. For the embedding 36 of the sawtooth structures 22 (FIG. 2(*a*)), a laminating adhesive can in particular be employed in this case.

In the value document 200 of FIG. 10(*h*), a microstructure 168 is applied to a paper ply 186 with a window 188 and embedded together with the paper ply 186 between two foils 202, 204. The motif image 166 is present in the region of the window 188 on the foil 204 bordering on the paper ply 186. The motif image 166 here can lie on the outer side of the foil 204, as shown in FIG. 10(*h*), as well as on the inner side of the foil. The motif image 166 and the microstructure 168 together form a security element 164 according to the invention.

Finally, in the value document 210 of FIG. 10(*i*), a microstructure 168 is applied to a foil ply 184 and a paper ply 186 with a window 188 and embedded together with the foil ply 184 and the paper ply 186 between two laminate foils 202, 204. The motif image 166 here can be present on the outer side of the foil 204, as shown in FIG. 10(*i*), can be present on the inner side of the foil 204, or can also be present on the upper side or underside of the foil ply 184. In all cases, the motif image 166 is present in the region of the window 188 and forms together with the microstructure 168 a security element 164 according to the invention.

The motif image can in all embodiments be in particular a printed or embossed motif structure, a structured metal layer, a color-shifting motif layer, a diffractive motif layer, such as a hologram, a structured multi-layer construction, a structured subwavelength grating, a moth-eye structure, a printed structure, a layer with negative patterns, such as negative characters, or a combination of the stated variants.

The change of viewing directions (B and C in FIG. 2) can be effected not only by tilting or rotating the security element, but also by curving the see-through security element. For this purpose, a predetermined motif to be represented can first be distorted, and the motif image and the lamella structure thereabove be mutually coordinated in such a way that the motif to be represented becomes visible undistorted in transmission at a predetermined curvature of the see-through security element.

The invention claimed is:

1. A security element comprising:

at least one microstructure which has a visual appearance that is viewing angle-dependent in transmission, and wherein the at least one microstructure is formed from an arrangement of a multiplicity of structure elements with a characteristic structure spacing of 1 μm or more, said security element containing at least one motif image which, through the viewing angle-dependent visual appearance of the microstructure, is visible in transmission from certain viewing angles, and invisible in transmission from other viewing angles, the security element includes an embossing lacquer layer and the structure elements are embossed into the lacquer layer, the structure elements are provided in partial regions with an opaque coating, and wherein the microstructure is permanently arranged on the motif image and the microstructure and the motif image together have a thickness of 50 μm or less.

2. The security element according to claim 1, wherein at least one microstructure of the security element comprises a lamella structure having a multiplicity of substantially parallel extending lamellae.

3. The security element according to claim 2, wherein at least one lamella structure is formed by a partly metallized asymmetric sawtooth structure with metallized first, less strongly inclined flanks and with non-metallized second, more strongly inclined flanks.

4. The security element according to claim 3, wherein the first, less strongly inclined flanks have an angle of inclination between 10° and 60° and the second, more strongly inclined flanks an angle of inclination between 50° and 110°, wherein the two angles of inclination differ by at least 20°.

5. The security element according to claim 1, comprising a plurality of microstructures comprising lamella structures which differ in one or several of the parameters of lateral orientation, color, width, height, relief form and spacing, and wherein the differing lamella structures are arranged in the form of a motif.

6. The security element according to claim 5, wherein the differing lamella structures are arranged in the form of a motif, wherein the motif of the lamella structures and at least one motif image of the security element complement each other to form a total information item in transmission from certain viewing angles.

7. The security element according to claim 1, wherein the structure elements are provided in partial regions with an opaque coating.

8. The security element according to claim 7, wherein the opaque coating is configured to be multi-layer.

9. The security element according to claim 7, wherein the opaque coating is configured as a thin-film element with a color-shift effect.

10. The security element according to claim 1, wherein the security element has a transparent or translucent substrate, and the at least one microstructure and the motif image are arranged on opposing surfaces of the substrate.

11. The security element according to claim 1, wherein the security element comprises a transparent, translucent or opaque substrate, and the at least one microstructure and the motif image arc arranged on the same surface of the substrate.

12. The security element according to claim 1, wherein the at least one microstructure is arranged directly on the motif image.

13. The security element according to claim 1, wherein the motif image comprises one or more of, or a combination of, a plurality of a printed or embossed motif structure, a structured metal layer, a color-shifting motif layer, a diffractive motif layer, a structured multi-layer construction, a structured sub-wavelength grating, a moth-eye structure, a printed structure, and a layer with negative patterns.

14. The security element according to claim 1, wherein the security element contains a second motif image which is applied to at least one microstructure, so that only the first motif image is visible in transmission from certain viewing angles and only the second motif image from other viewing angles.

15. The security element according to claim 1, wherein the microstructure and the motif image together have a thickness of 20 μm or less.

16. The security element according to claim 1, wherein the structure elements have either or both a characteristic structure spacing of 5 μm or more and the structure elements have a structure size of 1 μm or more.

17. The security element according to claim 1, wherein the structure elements are arranged substantially periodically, and the period given by the characteristic structure spacing is superimposed by a random fluctuation of the structure spacings with an amplitude between 1% and 5%.

18. The security element according to claim 1, wherein in the motif image of the security element, a predetermined motif to be represented is distorted, and the motif image and at least one microstructure are so mutually coordinated that the motif to be represented is visible undistorted in transmission at a predetermined curvature of the security element.

19. The security element according to claim 18, wherein the security element is a transfer element for transfer to a target substrate.

20. A method for manufacturing a security element, the method comprising the steps:

providing the security element with at least one microstructure with a visual appearance that is viewing angle-dependent in transmission;

forming the at least one microstructure from an arrangement of a multiplicity of structure elements with a characteristic structure spacing of 1 μm or more; the security element including an embossing lacquer layer and the structure elements being embossed into the lacquer layer providing the security element with at least one motif image which is visible in transmission from certain viewing angles, and invisible in transmission from other viewing angles, wherein the microstructure is permanently arranged on the motif image; and producing the security element with a thickness of the microstructure and the motif image together of 50 μm or less, wherein the structure elements are provided in partial regions with an opaque coating.

21. The method according to claim 20, including forming at least one microstructure of the security element by a lamella structure comprising a multiplicity of substantially parallel extending lamellae.

22. The method according to claim 21, wherein the step of producing at least one lamella structure is carried out by:

applying an embossing lacquer layer to a substrate, embossing the embossing lacquer layer and hardening the embossed embossing lacquer layer in the form of a lamella structure with a multiplicity of substantially parallel extending lamellae, coating the lamella structure with a metallization over the full area, etching the metallization by an etching operation, and ending the etching step as soon as the metallization present on the lamellae is reduced to a preselected layer thickness appearing transparent, or is completely etched through.

23. The method according to claim 22, wherein the etching methods used are physical etching methods, ion etching, ion beam etching, reactive plasma etching or atmospheric plasma etching, or chemical etching methods employing acids or bases.

24. The method according to claim 21, wherein at least one lamella structure is formed by a partly metallized asymmetric sawtooth structure, and wherein a coating of the sawtooth structure is effected by chemical coating, vapor deposition, sputtering, plasma-enhanced vapor deposition, by CVD or by printing on metal particles.

25. A data carrier, comprising the security element recited in claim 1, or a security element made according to claim 20.

26. A method for manufacturing a data carrier, comprising applying to or incorporating into a data-carrier substrate the security element recited in claim 1.

27. The method according to claim 26, wherein the data-carrier substrate has a see-through region, and wherein the security element is applied to the data-carrier substrate, or incorporated into the data-carrier substrate, in the see-through region.

28. A method for manufacturing a data carrier, comprising:

providing a data-carrier substrate, providing the data-carrier substrate with at least one motif image, and providing the data-carrier substrate in the region of the at least one motif image with at least one microstructure with a visual appearance that is viewing angle-dependent in transmission, which is formed from an arrangement of a multiplicity of structure elements with a characteristic structure spacing of 1 μm or more, the security element including an embossing lacquer layer and the structure elements being embossed into the lacquer layer so that the at least one microstructure and the at least one motif image form a security element, wherein the microstructure is permanently arranged on the motif image and the microstructure and the motif image together have a thickness of 50 μm or less, wherein the motif image is visible in transmission from certain viewing angles and invisible in transmission from other viewing angles, wherein the structure elements are provided in partial regions with an opaque coating.

* * * * *